US006675771B2

(12) United States Patent
Pursifull

(10) Patent No.: US 6,675,771 B2
(45) Date of Patent: Jan. 13, 2004

(54) REPEATABILITY IN CONTROL SYSTEMS THAT UTILIZE DISCRETIZED FEEDBACK

(75) Inventor: Ross D. Pursifull, Dearborn, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 178 days.

(21) Appl. No.: 10/040,678

(22) Filed: Dec. 28, 2001

(65) Prior Publication Data

US 2003/0125820 A1 Jul. 3, 2003

(51) Int. Cl.[7] ..... F02D 1/00
(52) U.S. Cl. ..... 123/399; 123/361
(58) Field of Search ..... 123/339.1, 339.12, 123/339.19, 339.23, 360, 361, 376, 395, 398, 399; 251/129.11

(56) References Cited

U.S. PATENT DOCUMENTS 4,263,782 A * 4/1981 Matsumoto et al. ..... 60/276
4,638,228 A 1/1987 Junginger et al. ..... 318/569
4,896,090 A * 1/1990 Balch et al. ..... 318/52
5,021,781 A 6/1991 Salazar et al. ..... 341/13
5,852,996 A * 12/1998 Nakamura et al. ..... 123/399
5,896,839 A * 4/1999 Togai ..... 123/295
6,055,960 A * 5/2000 Marumoto et al. ..... 123/399
6,073,610 A * 6/2000 Matsumoto et al. ..... 123/396
6,390,064 B2 * 5/2002 Marumoto et al. ..... 123/399
6,502,548 B2 * 1/2003 Kuretake ..... 123/399
6,510,840 B2 * 1/2003 Tadashi ..... 123/399

* cited by examiner

*Primary Examiner*—John Kwon
(74) *Attorney, Agent, or Firm*—Brinks hofer Gilson & Lione

(57) ABSTRACT

A control system must establish the same throttle position repeatedly to obtain fuel efficiency and prevent speed dropping during idling. Sensors determine the throttle position or other engine parameter associated with the throttle position and create an analog signal. The information is processed by a analog-to-digital converter which places the signal into a discrete level. A controller receives this signal and compares it to a point assigned between two discrete levels representing the desired throttle position or engine parameter. Therefore, the signal will never equal the assigned point. The controller makes corrections based on this comparison after every iteration because the error will never reach zero.

22 Claims, 5 Drawing Sheets

REPEATABILITY IN CONTROL SYSTEMS THAT UTILIZE DISCRETIZED FEEDBACK

FIELD OF THE INVENTION

The present invention relates to automotive vehicles, and in particular to an apparatus and method for controlling throttle position.

BACKGROUND OF THE INVENTION

Throttle control is important in maintaining fuel efficiency and preventing speed drop when engine loads are applied during idling. Throttle position is typically maintained through the use of a control device. This control device receives position feedback from a throttle position sensor, analyzes the feedback, and manipulates the throttle actuator. An important aspect of such a control device is its ability to establish an operating position and repeatedly maintain that position without excessive variation.

Prior devices have used discretized feedback to maintain this repeatability and control. The feedback signal is implemented as an analog feedback voltage. The feedback voltage enters an analog-to-digital (AtoD) converter. The AtoD converter then converts the analog signal into a plurality of discrete levels dependent on its input voltage. The range of voltage between zero and the reference voltage is partitioned into the total number of levels, typically $2^{(No.\ of\ bits)}$. Therefore, to a controller, the digital output from an analog input at the top of a voltage interval is the same as the digital output from an analog input at the bottom of a voltage interval. As a result, single digital level corresponds to a range of analog voltages, and thus, a range of actual positions.

Typical throttle position feedback control systems assign a desired set point to a discretized level. The set point is the desired operating position of the throttle. Within the control system, the discretized feedback level is compared with the set point level. If the feedback level is different than the set point level, the control device recognizes the variance and corrects the throttle position. If the feedback level is the same as the set point level, the control device does not recognize any error or variance and does not issue any correction. This allows the feedback voltage to drift within the set level without any sensed error, which allows the throttle position in turn to drift within the interval without any correction. The drifting creates a lack of repeatability and fine motion control. Fine motion control is the ability to obtain positions within a minute range after a general range has been achieved. By way of example, if the command positions is 2 and the descretization level is ⅛, then the actual position may be any throttle position between 1 15/16 and 2 1/16. This lack of repeatability and fine motion control creates problems in electronic throttle systems during idling. Because the throttle position in current devices is allowed to drift within the voltage interval engine idle speed control is degraded.

Furthermore, current control systems typically experience hysteresis in the feedback control sensor. Hysteresis is a property of a sensor which makes sensor output dependent on movement direction. Therefore, in a sensor experiencing hysteresis, the sensed motion lags the actual motion. The hysteresis causes inaccuracy and variability because throttle position error depends on the direction of travel. A new control system is therefore needed to improve repeatability and eliminate feedback sensor hysteresis.

BRIEF SUMMARY OF THE INVENTION

An embodiment of the invention includes at least one sensor for detecting throttle position and translating said throttle position into an analog signal. The signal is then sent to an AtoD converter which converts the analog signal into multiple discrete feedback levels. A controller determines a desired throttle position and establishes the desired throttle position between two discrete feedback levels. The controller then compares the discrete feedback level with the desired throttle position and determines a correction effort based on the comparison. An adjusting means receives the correction effort and adjusts the throttle position in accordance with the correction effort.

In another aspect of the invention, an embodiment of a method of controlling throttle position is provided. The method includes the steps of detecting a throttle position and translating the throttle position into a feedback voltage. The method then encodes the feedback voltage from the throttle into a plurality of discrete feedback levels. A desired throttle position is established, and the desired throttle position between two of said discrete feedback levels is located. These feedback levels are compared to the desired throttle position set point, and the throttle position is adjusted based on the comparison.

A third embodiment includes one or more sensors for detecting at least one valve position and translating the position into an analog signal. These signals are fed into at least one AtoD converter. The AtoD converter transforms the analog signal into a plurality of feedback levels. A controller then determines a desired valve position. The controller places the desired valve position between two discrete feedback levels and compares the discrete feedback level with the desired valve position. The controller determines a corrective effort based on the comparison. The controller sends the corrective effort to an adjusting means, which adjusts the valve position in accordance with the correction effort.

In another aspect of the invention, an embodiment of a method of controlling valve position is provided. The method includes the steps of determining valve position and translating the valve into at least one feedback voltage. These voltages are encoded into a plurality of discrete levels. A desired valve position is established. The method then locates the desired valve position between two of the discrete feedback levels. The desired valve position is compared with the feedback levels and the valve position is adjusted based on the comparison.

Other systems, methods, features, and advantages of the invention will be or will become apparent to one skilled in the art upon examination of the following figures and detailed description. All such additional systems, methods, features, and advantages are intended to be included within this description, within the scope of the invention, and protected by the accompanying claims.

DETAILED DESCRIPTION OF THE PRESENTLY PREFERRED EMBODIMENTS

Figure 1:
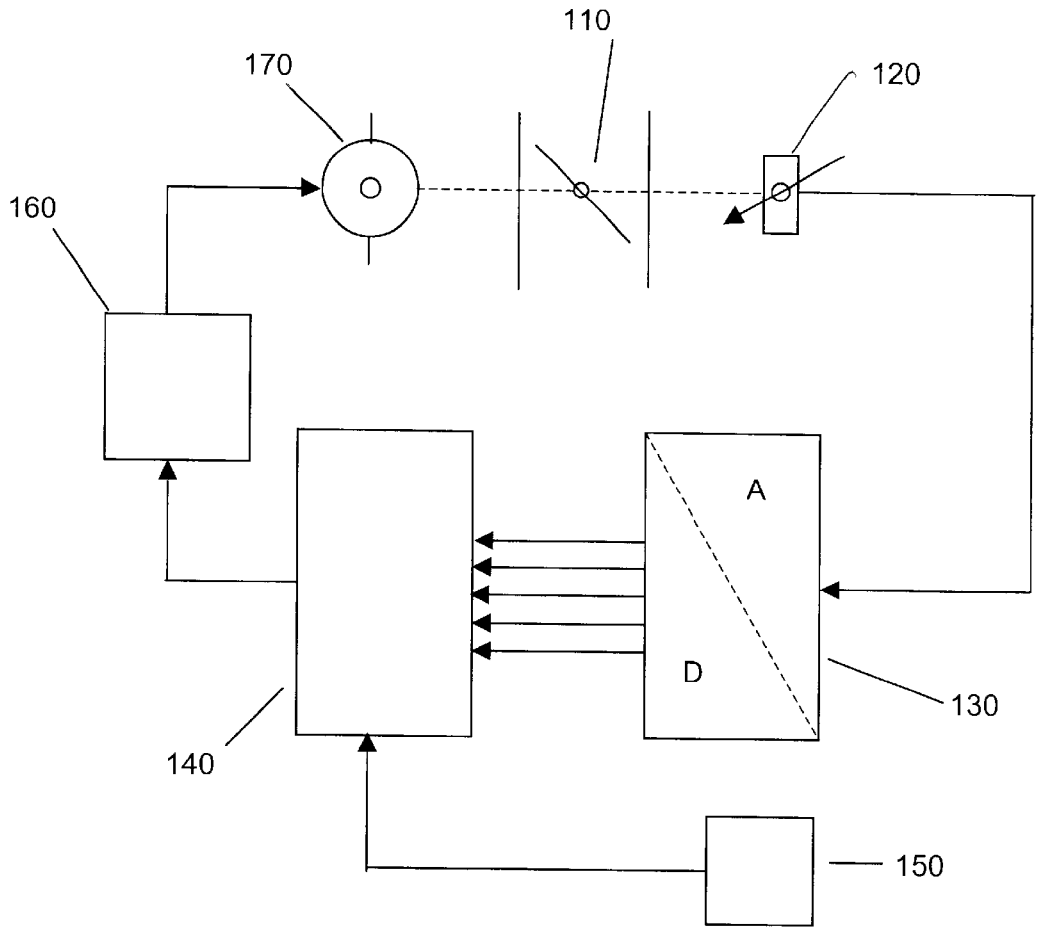
FIG. 1 is a schematic diagram of a closed feedback control loop for throttle position using a position sensor to determine throttle position, in accordance with the present invention.

FIG. 1 depicts a closed control loop for throttle position. In the control loop, the position of the throttle 110 is read by a position sensor 120 such as a potentiometer or the like. The throttle position is the mechanical displacement of the throttle 110. The device then encodes the signal as analog feedback voltage. The analog feedback signal is preferably continuous. The feedback voltage travels to an AtoD converter 130. The AtoD converter 130 reads this feedback voltage and encodes it into discrete signals in levels The AtoD converter encodes the signal into $2^{(No.\ of\ Bits)}$ levels. The discrete feedback signals are then sent to the controller 140. The controller 140 can be a microprocessor or microcomputer. The AtoD converter 130 may be physically integrated with the controller 140 to simplify the architecture of the system. The controller 140 then reads a throttle position command signal from the throttle position command input 150 and the discrete levels from the AtoD converter 130 and calculates corrective efforts by following a procedure described in FIG. 2. The controller then achieves the corrective effort through drive electronics 160 to the adjusting means 170, such as an actuator, electric motor, servo, or the like, which makes corrections to the position of the throttle 110 based on the corrective effort by applying an electric current to the adjusting means.

Figure 2:
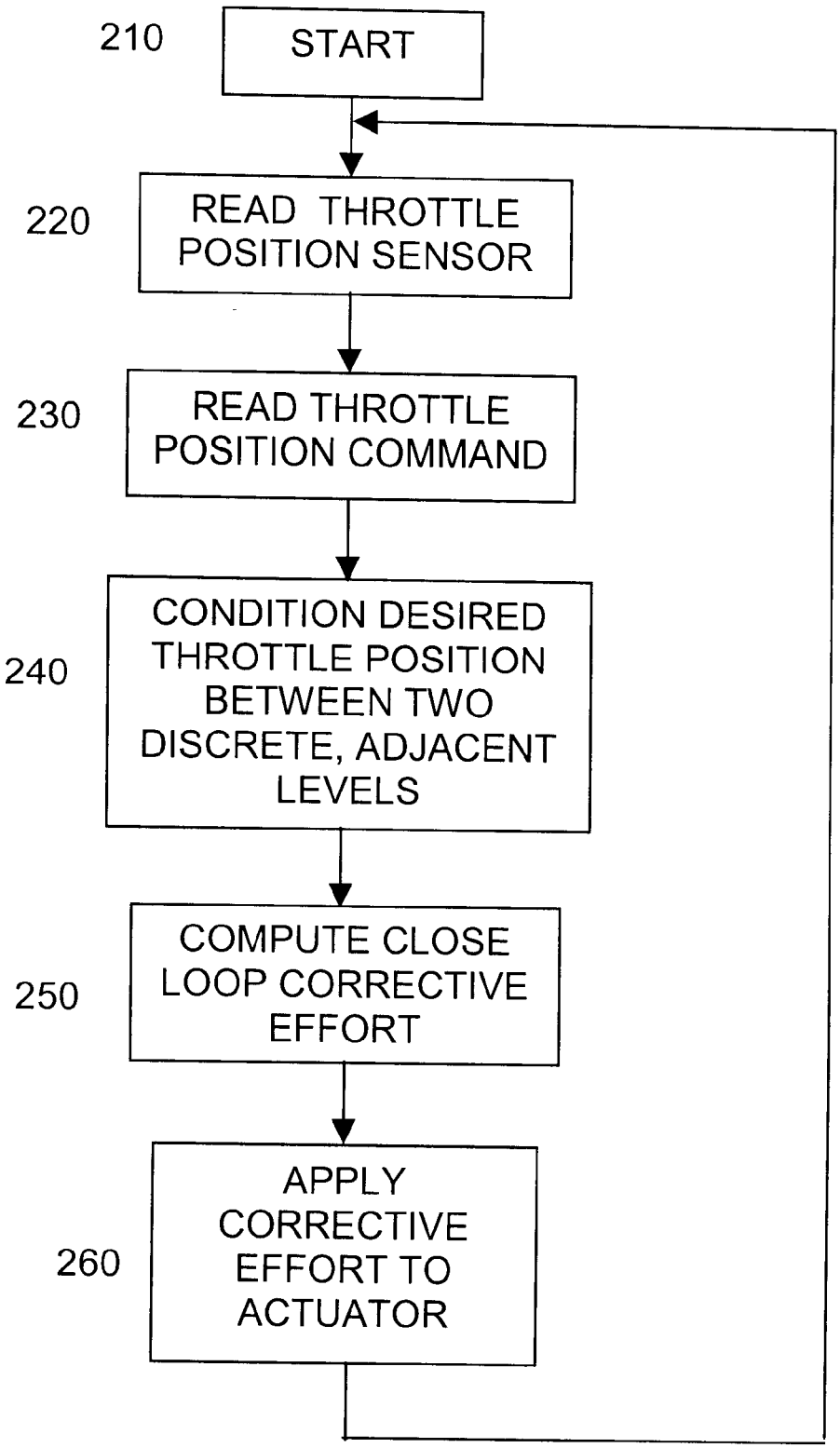
FIG. 2 is a flow diagram illustrating a routine for creating corrective efforts by the controller in FIG. 1.

FIG. 2 is a flowchart illustrating a preferred procedure for determining corrective efforts regarding the throttle position for a closed control loop. The controller initially has no information on the throttle position 210. The controller reads the discrete levels representing the throttle position 220 sent from the AtoD converter 130 (FIG. 1). Throttle position leaving the AtoD converter 130 (FIG. 1) must inherently be within a discrete level of the AtoD converter 130 (FIG. 1). The actual position cannot be between levels due to the nature of AtoD converters. The controller then reads the throttle position command signal 230. The command indicates the degree to which the throttle should be opened. The controller next centers that command between two discrete levels of the AtoD converter 240. The centering disallows the measured throttle position from ever achieving the desired throttle position because the measured throttle position is inherently within a level and the desired throttle position is located between levels. The controller is therefore forced to compute a corrective effort 250 because the measured throttle position is either above or below the desired throttle position. A method of computing the corrective effort is through the use of a PID controller, which provides a fast rise time, minimal overshoot, and a fast settle time. Then, the controller sends this corrective effort to the actuator to adjust throttle position 260. Because the measured throttle position can never be the same as the desired throttle position, corrections are always created. The controller therefore never allows the feedback voltage to drift, and, as a result, the actual throttle position is never allowed to drift.

Figure 3:
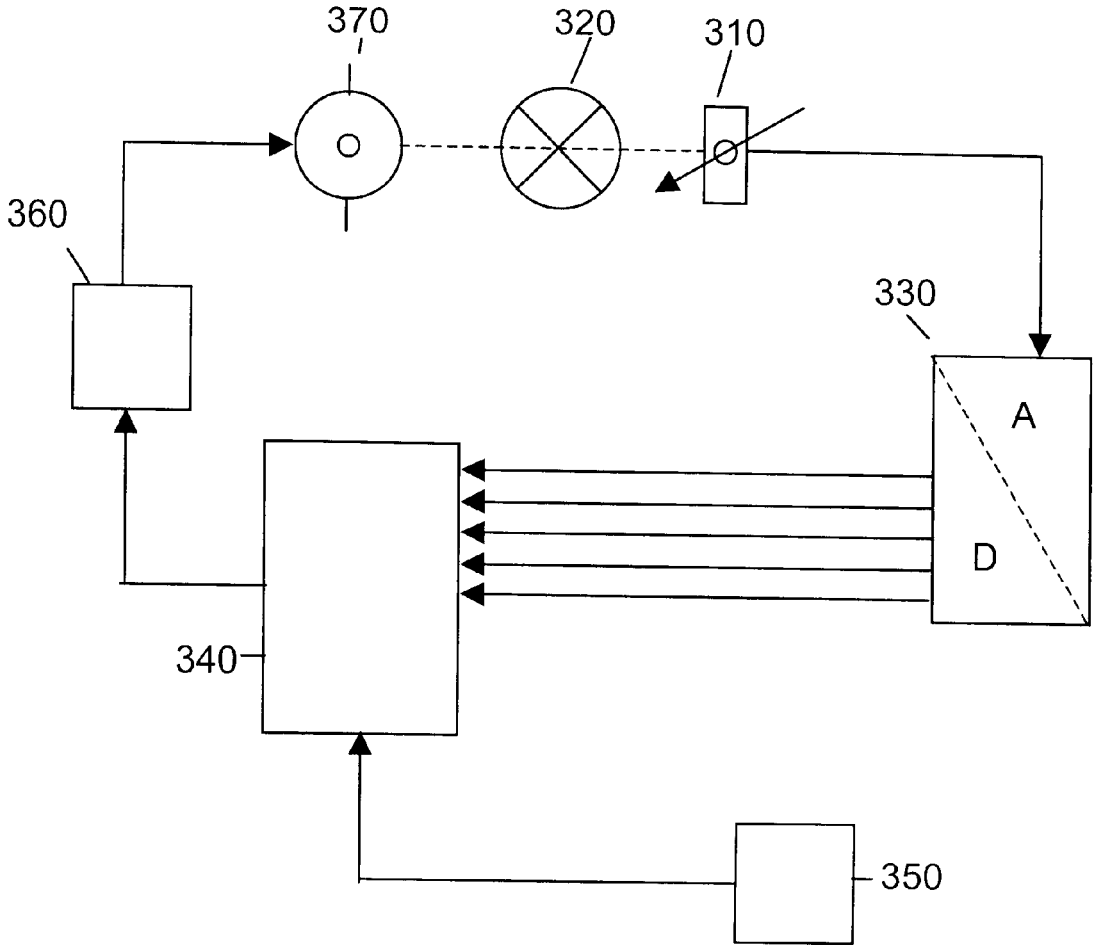
FIG. 3 is a schematic diagram of a feedback loop for valve position using a position sensor to determine valve position, in accordance with the present invention.

FIG. 3. illustrates another embodiment of the invention. The embodiment in this Figure represents a apparatus for valve position control. The valve position controller governs to what degree the valve is open. In the Figure, a valve position sensor 310 measures the position of the valve 320. This sensor 310 can be a potentiometer or the like. The sensor 310 then creates an analog signal, which is sent to an AtoD converter 330. A controller 340 then receives these feedback signals as well as the command for valve position 350. The controller 340 preferably follows the procedure in FIG. 4 to create a corrective effort. The controller 340 sends the corrective effort through drive electronics 360, which then applies an electric current to the adjusting means 370, which makes the corrections to the position of the valve 320.

Figure 4:
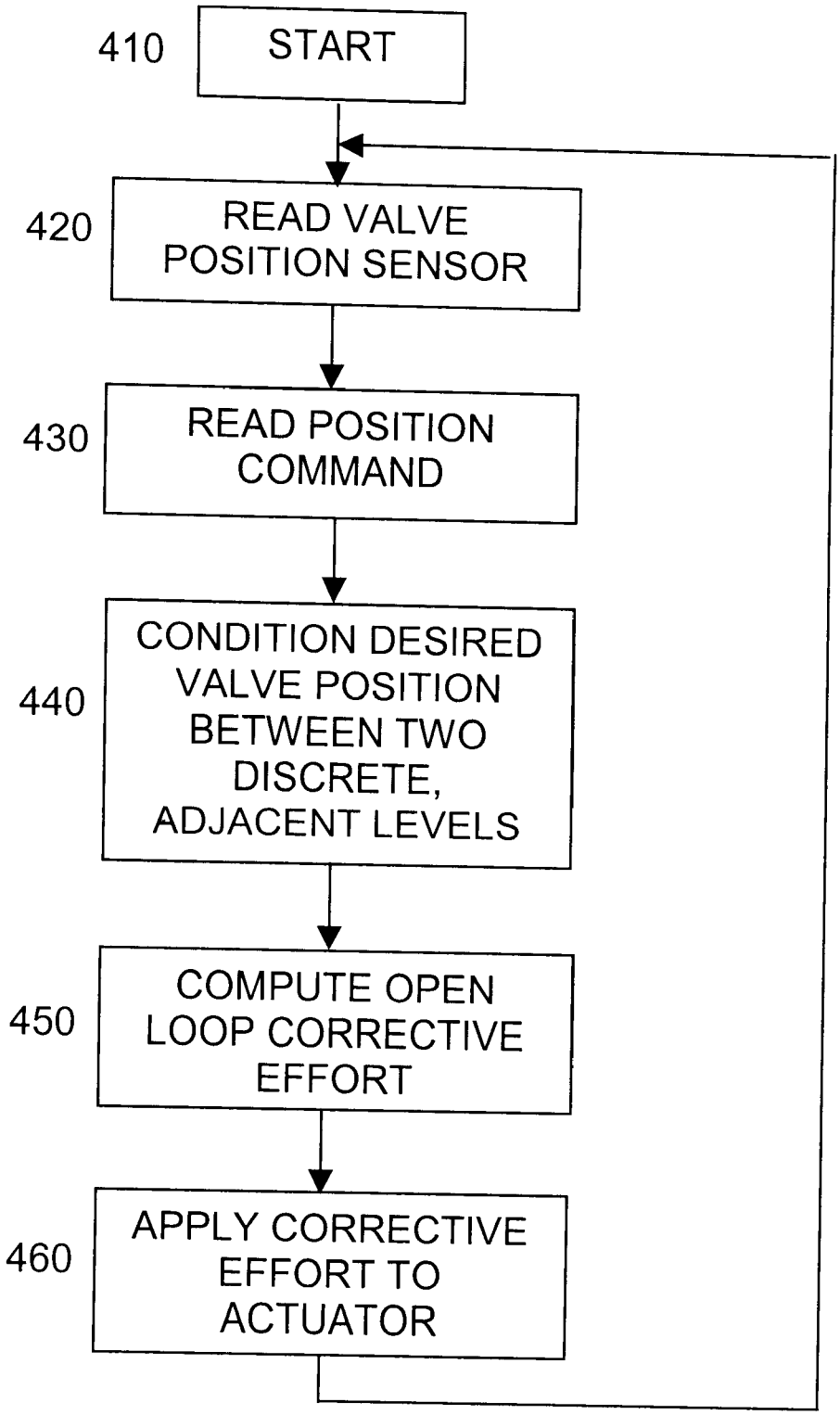
FIG. 4 is a flow diagram illustrating a routine for creating corrective efforts by the controller in FIG. 3.

FIG. 4 describes a preferred procedure implemented by the controller follows to create a corrective effort. The controller initially has no information regarding valve position 410. The controller then receives the discrete levels representing valve position 420 sent from an AtoD converter 330 (FIG. 3). Next, the controller reads the command for desired valve position 430. The command indicates the degree to which the valve should be opened. The controller then centers the desired valve position between two discrete levels of the AtoD converters 330 (FIG. 3) 440. The centering disallows the measured valve position from ever achieving the desired valve position because the measured valve position is within a level of the AtoD converter and the desired valve position is between levels. Therefore, the controller is forced to compute a corrective effort 450. Then, the controller sends this corrective effort to the actuator to correct valve position 470. Because the measured valve position can never be the same as the desired valve positions, corrections are always created. Therefore, the controller never allows the feedback voltage to drift, and, as a result, the actual valve position is never allowed to drift within a level.

Figure 5:
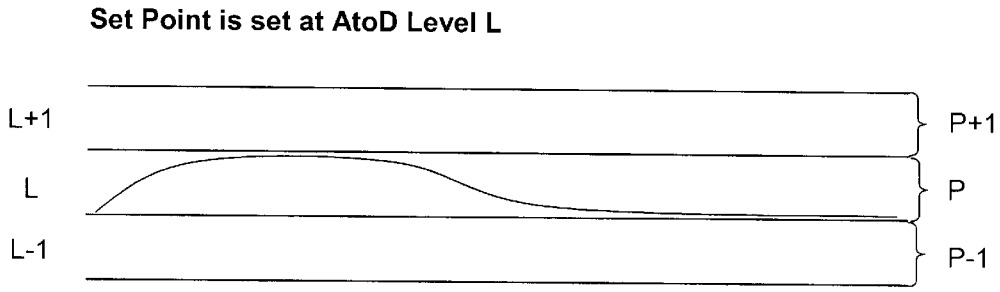
PRIOR ART FIG. 5
FIG. 5 is a graph of the position of prior art feedback in discrete levels overtime.
Figure 6:
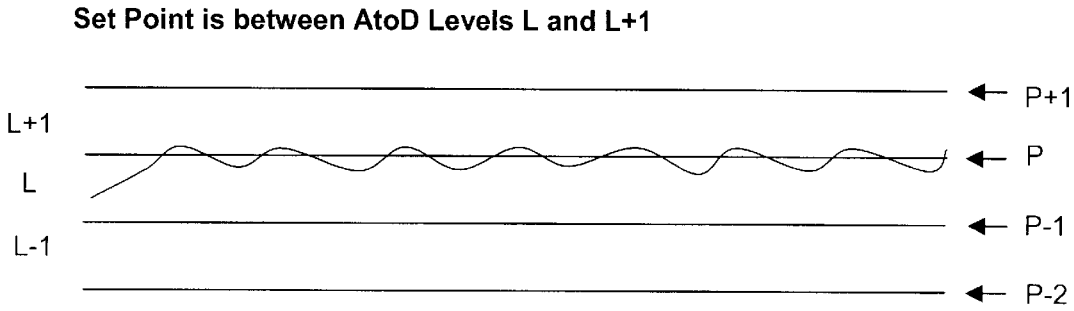
FIG. 6 is a graph of the position of the feedback in discrete levels over time for the embodiments of the present invention.

FIGS. 5 and 6 further exemplify the theory behind the embodiments of FIGS. 1 and 3. FIG. 5 represents the assignment of throttle position to discrete levels in the prior art. The Figure contains three discrete levels, L−1, L, and L+1. These levels are part of the many levels produced by the AtoD converter. Throttle positions are also assigned levels. In the Figure, the three positions are labeled P−1, P, and P+1. As indicated, position was actually a range in the prior art. In FIG. 5, the set position is set to level L. Therefore, the voltage can drift anywhere within the discrete level L without showing any error. As a result, the command can only dictate that the throttle position be within a range and cannot predict where in that range the throttle position is located. The unpredictability of the position prevents the system from continuously obtaining the same position, therefore, lowering repeatability.

FIG. 6 demonstrates the utility of the placing the desired throttle position between levels in the preferred embodiment of the invention. In FIG. 6, the controller has conditioned the desired throttle position between discrete levels L and L+1. Placing the desired throttle position between discrete levels forces error to continuously exist, forcing the position to continuously correct itself, and preventing the voltage and position from drifting in either level L or L+1, which are adjacent to the desired throttle position 610. The result is that the position is centered on the transition between levels of the AtoD converter, as opposed to anywhere in a given level. This result improves repeatability. The throttle position will respond in a similar fashion every time a similar command is issued. This allows the controller to predict the position with a high level of confidence, improving idle speed control.

Furthermore, hysteresis is prevented by the continuous corrections to throttle position. By placing desired throttle positions between levels, corrections are continuously created. These corrections causes persistent motion, causing direction to oscillate. As a result, on average, the error due to hysteresis is reduced to zero.

Various embodiments of the invention have been described and illustrated. However, the description and illustrations are by way of example only. Many more embodiments and implementations are possible within the scope of this invention and will be apparent to those of ordinary skill in the art. Therefore, the invention is not limited to the specific details, representative embodiments, and illustrated examples in this description. Accordingly, the invention is not to be restricted except in light as necessitated by the accompanying claims and their equivalents.

What is claimed is:

1. A method of controlling throttle position comprising the steps of:

detecting a throttle position;

translating said throttle position into a feedback voltage;

encoding feedback voltage from the throttle into a plurality of discrete feedback levels;

establishing a desired throttle position;

locating the desired throttle position between two of said discrete feedback levels;

calculating a corrective effort to reduce the difference between the feedback levels and the desired throttle position; and applying that corrective effort with the throttle position actuator.

2. The method of claim 1 wherein said step of detecting a throttle position further comprises establishing the mechanical displacement of the throttle.

3. The method of claim 2 wherein said step of translating said throttle position into a feedback voltage further comprises creating an output voltage proportional to the mechanical displacement of the throttle.

4. The method of claim 1 wherein said step of encoding feedback voltage from the throttle into said plurality of discrete feedback levels further comprises encoding in an analog-to-digital converter.

5. The method of claim 1 wherein said step of calculating a corrective effort to reduce the difference between the feedback levels and the desired throttle position further comprises determining whether the discrete feedback level is above or below the desired throttle position and determining the appropriate adjustment to throttle position.

6. The method of claim 1 wherein said step of adjusting the throttle position according to said corrective effort further comprises applying an appropriate electric voltage to a means for adjusting the throttle position.

7. The method of claim 6 wherein the means for adjusting throttle position is further comprised of at least one of an actuator, an electric motor, and an electric servo motor.

8. A throttle feedback control system for regulating throttle position comprising:

at least one sensor means for detecting said throttle position and translating said throttle position into an analog signal;

an analog-to-digital converter in communication with said sensor means for converting the analog signal into at least one discrete feedback signal;

at least one controller means in communication with said converter for determining a desired throttle position set point, establishing said desired throttle position set point between two said discrete feedback levels, comparing the discrete feedback level with said desired throttle position set point, and determining at least one correction signal based on said comparison;

drive electronics in communication with said controller for converting said at least one correction signal into at least one adjusting means command; and an adjusting means in communication said drive electronics for receiving said at least one adjusting means command and adjusting said throttle position in accordance with said at least one adjusting means command.

9. The throttle feedback control system of claim 8 wherein the at least one sensor means further comprises at least one potentiometer.

10. The throttle feedback control system of claim 8 wherein the controller further comprises a microcomputer or microprocessor.

11. The throttle feedback control system of claim 8 wherein the adjusting means further comprises at least one of an actuator, an electric motor and an electric servo motor.

12. A valve feedback control system for regulating throttle position comprising:

at least one sensor means for detecting a valve position and translating said valve position into at least one analog signal;

at least one analog-to-digital converter in communication with said at least one sensor means for converting the analog signal into at least one discrete feedback signal;

a controller means in communication with said at least one converter for obtaining a desired valve position, establishing said valve position between two said discrete feedback levels, comparing said at least one discrete feedback level with said desired valve position set point, and determining at least one corrective effort based on said comparison; and drive electronics in communication with said controller for converting said at least one correction signal into at least one adjusting means command; and an adjusting means in communication said drive electronics for receiving said at least one adjusting means command and adjusting said valve position in accordance with said at least one adjusting means command.

13. The valve feedback control system of claim 12 wherein the at least one sensor means further comprises at least one potentiometer.

14. The valve feedback control system of claim 12 wherein the controller further comprises a microcomputer or microprocessor.

15. The valve feedback control system of claim 12 wherein the adjusting means further comprises at least one of an actuator, an electric motor, and an electric servo motor.

16. A method of controlling valve position comprising the steps of:

detecting valve position;

translating said valve position into a feedback voltage;

encoding feedback voltage from the valve into a plurality of discrete feedback levels;

establishing a desired valve position;

locating the desired valve position between two of said discrete feedback levels;

calculating a corrective effort to reduce the difference between the feedback levels and the desired valve position; and applying that corrective effort with the valve position actuator.

17. The method of claim 16 wherein said step of detecting a valve position further comprises establishing the mechanical displacement of the valve.

18. The method of claim 16 wherein said step of translating said valve position into a feedback voltage further comprises creating an output voltage proportional to the mechanical displacement of the throttle.

19. The method of claim 16 wherein said step of encoding feedback voltage from the throttle into said plurality of discrete feedback levels further comprises encoding in an analog-to-digital converter.

20. The method of claim 16 wherein said step of creating a corrective effort to reduce the difference between the feedback levels and the desired valve position further comprises determining whether the discrete feedback level is above or below the desired valve position and determining the appropriate adjustment to valve position.

21. The method of claim 16 wherein said step of adjusting the valve position according to said corrective effort further comprises applying an appropriate electric voltage to a means for adjusting valve position.

22. The method of claim 21 wherein said means for adjusting valve position further comprises at least one of an actuator, an electric motor, and an electric servo motor.

* * * * *